US006737615B2

(12) United States Patent
Lange et al.

(10) Patent No.: US 6,737,615 B2
(45) Date of Patent: May 18, 2004

(54) HEAT CONDUCTOR COIL FOR HEATING A FLOWING GASEOUS MEDIUM AND ELECTRICAL RESISTANCE HEATING ELEMENT

(75) Inventors: Karl-Heinz Lange, Birkenfeld (DE); Ingo Schehr, Jockgrim (DE)

(73) Assignee: MicroHellix Systems GmbH, Ölbronn-Dürrn (DE)

( * ) Notice: Subject to any disclaimer, the term of this patent is extended or adjusted under 35 U.S.C. 154(b) by 69 days.

(21) Appl. No.: 10/093,084

(22) Filed: Mar. 6, 2002

(65) Prior Publication Data

US 2002/0125243 A1 Sep. 12, 2002

(30) Foreign Application Priority Data

Mar. 7, 2001 (DE) ..... 101 11 000

(51) Int. Cl.[7] ..... H05B 3/06

(52) U.S. Cl. ..... 219/536; 219/542; 219/461.1; 392/360; 392/379; 338/280; 338/283; 338/286

(58) Field of Search ..... 219/536, 537, 219/542, 532, 461.1, 546, 467.1; 392/347, 360, 379, 380, 381, 382, 383, 384, 385; 338/279, 280, 281, 282, 283, 286, 296

(56) References Cited

U.S. PATENT DOCUMENTS 3,218,437 A * 11/1965 Laing ..... 219/546
4,341,946 A * 7/1982 Ohnmacht et al. ..... 219/532
4,794,227 A * 12/1988 Antoniazzi et al. ..... 219/532
5,393,958 A * 2/1995 Gross et al. ..... 219/461.1
5,753,892 A * 5/1998 Gross et al. ..... 219/461.1
5,796,075 A * 8/1998 Gross et al. ..... 219/461.1
6,437,298 B1 * 8/2002 Mendieta ..... 219/461.1

FOREIGN PATENT DOCUMENTS

| | | |
|---|---|---|
| DE | 2530075 | 1/1977 |
| DE | 2535478 | 2/1977 |
| DE | 2944132 | 5/1981 |
| DE | 4443725 | 6/1996 |

* cited by examiner

*Primary Examiner*—Henry Bennett
*Assistant Examiner*—Fadi H. Dahbour
(74) *Attorney, Agent, or Firm*—Friedrich Kueffner

(57) ABSTRACT

A heat conductor coil for heating a flowing gaseous medium is configured to be attached to a support configuration and has a heat conductor wound in windings following an ascending line of a coil to form the heat conductor coil, wherein the ascending line of the coil defines a circumferential surface of the heat conductor coil. The heat conductor is deflected alternatingly in opposite directions within the circumferential surface of the coil out of the ascending line of the coil. The heat conductor coil is attached to a support plate by securing elements having a securing part for holding a winding of the heat conductor coil and a foot part for attaching the securing element to the support plate. The securing part is a tubular section with a substantially closed mantle surface and receives a winding of the heat conductor coil.

21 Claims, 5 Drawing Sheets

Fig. 8
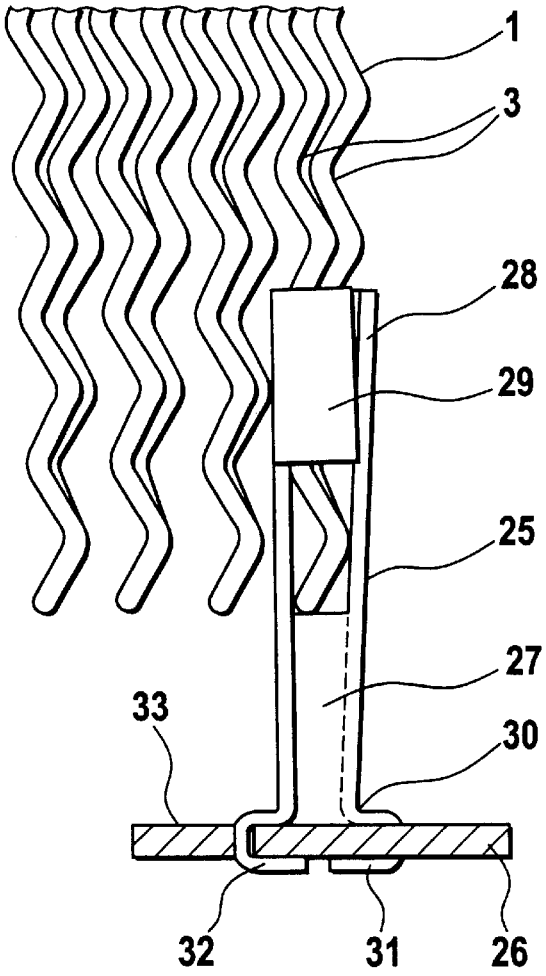
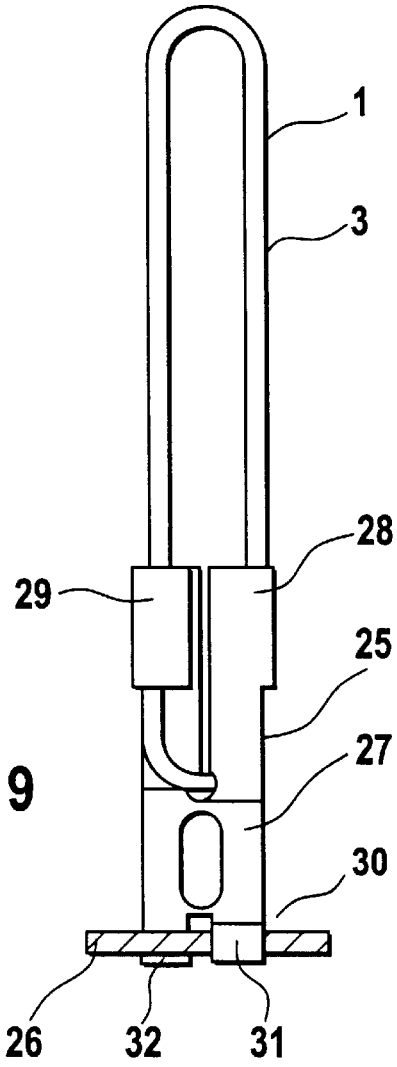
Fig. 9

Fig. 10
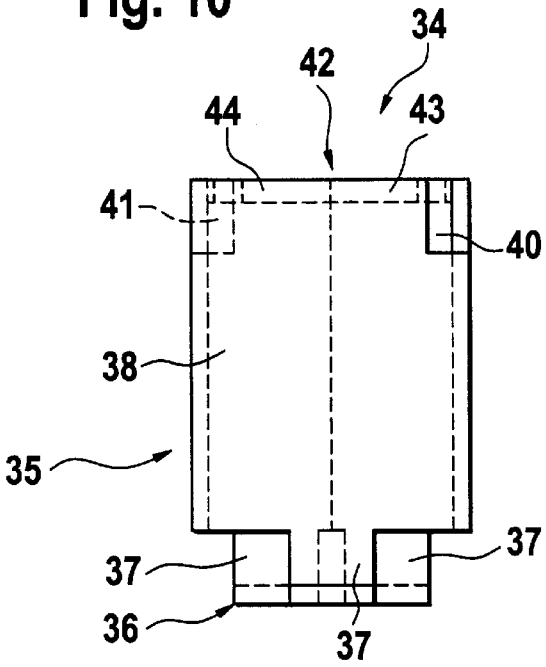
Fig. 11
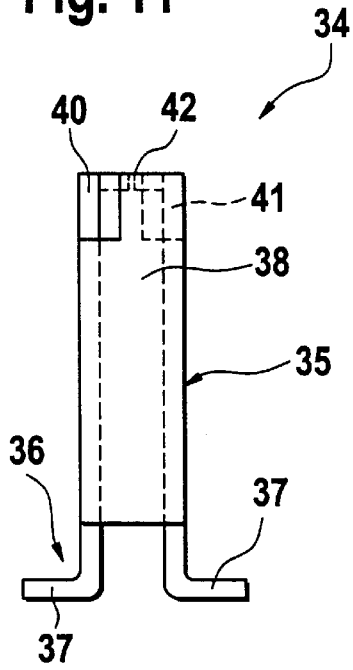
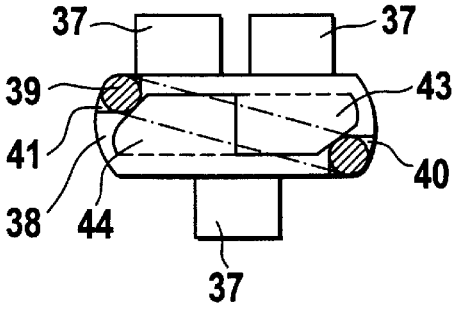
Fig. 12
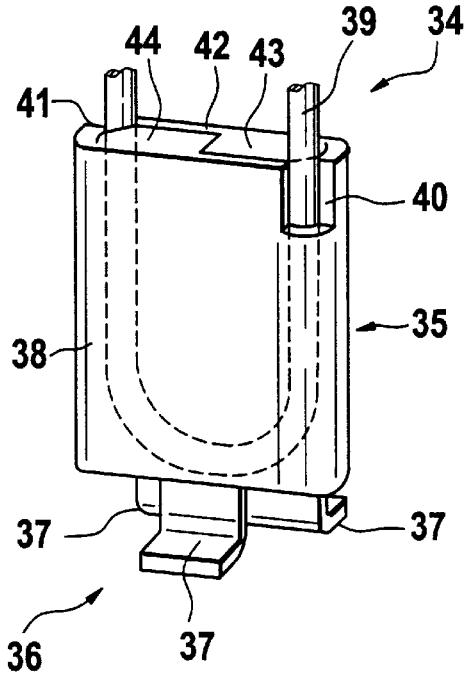
Fig. 13

HEAT CONDUCTOR COIL FOR HEATING A FLOWING GASEOUS MEDIUM AND ELECTRICAL RESISTANCE HEATING ELEMENT

BACKGROUND OF THE INVENTION

1. Field of the Invention

The invention relates to a heat conductor coil for heating a flowing gaseous medium, primarily air, as well as an electric resistance heating element with a heat conductor coil fastened with intermediate positioning of securing elements on a support plate.

2. Description of the Related Art

Coil-shaped, but also zigzag-shaped or meander-shaped, heat conductors are employed primarily as heating elements in electrical devices for heating air, for example, in hair dryers, heater fans, convection heaters or clothes dryers or similar applications. However, they can be used in the same way also for heating other gaseous media. In such devices, an airflow generated by a fan is guided through a heating member which is comprised of at least one such heating element. When the air flows through the heating element, heat exchange takes place between the heat conductor and the airflow, which heat exchange should occur as uniformly as possible and, if possible, without heat losses.

In most known heating elements the heat conductor is comprised of a coil-shaped or meander-shaped resistance wire which is connected directly on a support plate of electrically insulating and heat-resistant material such as, for example, Micanit (German patent documents DE 25 30 075 A1, DE 25 35 478 A1, DE-PS 29 44 132). These known heating elements have in common that the heating wire requires for its fixation direct contact with the support plate, and also that the type of connection of the heating wire on the support plate depends on the form of the heating element. Since the heating wire is supplied with electrical energy, the support plate not only must be electrically insulating but must also be comprised of a heat-resistant material, such as, for example, Micanit. As a result of the support plates positioned parallel to the flow direction, the flow cross-section is divided into individual chambers which impair a uniform heat exchange.

However, a heating element is already known in which the coil-shaped heat conductor is no longer directly fastened on the support plate but indirectly by means of securing elements which are connected on the support plate and on which, in turn, the heat conductor coils are fastened (DE 44 43 725 A1). This avoids, on the one hand, direct contact locations between the heat conductor and the support plates so that the durability of the support plates is extended. Moreover, this has the additional advantage that the flow cross-section is no longer divided by support plates which results in an improved heat dissipation and thus a greater efficiency.

In this known heating element, the securing elements for fixation of the heat conductor coils are comprised of a shaft having at one end a securing part for fixation of the coil and having at the other end a foot part for attachment on the support plate. The securing part forms a flat receptacle having a U-shaped undercut for a winding tip of a coil having a flat-oval up to a flat-rectangular cross-section. The foot part is comprised of two parallel legs, which project at a right angle from the shaft and have at their underside tabs which are pushed through slots in the support plate and are then bent.

This configuration of the heating element not only has the advantage that direct contact locations between the heat conductor and the support plate are prevented but also the additional advantage that, as a result of the securing elements, which can be very narrow in the flow direction, the heat conductor coil is freely positioned within the airflow so that a relatively beneficial heat exchange can be achieved.

SUMMARY OF THE INVENTION

It is an object of the present invention to provide a possibility for a further improvement of the heat utilization of such electrical resistance heating elements.

In accordance with the present invention, this is achieved in that the heat conductor forming the coil is deflected within the circumferential surface of the coil defined by the ascending line of the coil out of this ascending line alternatingly in opposite directions.

In regard to the use of such a heat conductor coil, the present invention is directed to employing such a coil in a heating element for heating a flowing gaseous medium, primarily air, wherein at least one coil with interposition of securing elements is fastened on a support plate.

Furthermore, the invention relates to an electrical resistance heating element in which the securing elements for attachment of the heat conductor coil on the support plate have on a shaft a securing part for securing a winding of the heat conductor coil and a foot part for attachment on the support plate, wherein the securing part has two arms on which a receptacle for attachment of the section of a winding of the heat conductor coil is formed, respectively.

The basic idea of the invention resides in that as a result of the configuration of the heat conductor coil, in particular, a coil configuration of a flat-rectangular cross-section, with undulations of a short wave length relative to the dimensions of the coil within the circumferential surface of the coil defined by the ascending line of the coil, the flow cross-section is penetrated by the heat conductor generating the heat with a very tight mesh. This results in multiple turbulences of the air flowing through a heating element provided with such a coil with the result that a substantially more beneficial heat transfer from the heat conductor onto the air flowing therethrough is realized. In this way, for the same heat output, a significant reduction of the energy consumption by 20 to 25 % is achieved.

Special advantages in this connection result when the heat conductor is comprised of a thermistor wire, i.e., of a material in which the electrical resistance changes with the temperature, in particular, of a thermistor material having a positive temperature coefficient (PTC).

A heat conductor coil embodied according to the invention can be used basically for any suitable heating element in which the coil is arranged transversely to the flow direction. However, special advantages result when using the coil in an electrical resistance heating element in which at least one coil is connected to a support plate with interposition of securing elements.

Functional and manufacturing advantages also result from the inventive configuration of the securing elements for the heat conductor coil, i.e., of the intermediate members between the heat conductor coil and the support plate which effect the substantially free suspension of the coil. With the special configuration of the securing part of this securing element which holds one winding of the coil on two oppositely positioned sections, a functional securing of the coil without deflection of individual windings and a safe fixation of the coil result. On the other hand, the foot part of the securing elements can be configured according to the corresponding configuration of the heating element. In this connection, it is possible to guide the heat conductor coil approximately in a circular ring shape about a central circular support plate wherein the securing elements are positioned in the plane of the support plate and of the coil, but also to arrange the securing elements at a right angle to a support plate in order to be able to position the coil in the corresponding direction.

A particularly advantageous embodiment of the heating element solves the problem of known securing elements which, as a result of their particular shape, have the tendency to retain dust particles and lint entrained in the gas flow. Over the course of time, this results in the collection of dust and lint which initially results in the surface area of the flow cross-section being reduced and the flow resistance being increased so that for the operation of the heating element more energy must be supplied.

More important however is the risk that the dust and lint deposits could ignite on the hot heat conductor thus causing a fire. In order to counteract this danger, it is therefore necessary to service and clean devices provided with known heating elements in regular intervals. This problem is of particular importance in regard to clothes dryers in which a more than proportional amount of lint is entrained in the gas flow.

The solution to this problem is realized with the invention with a securing element with the following features: the securing element is comprised of a tubular section with substantially closed mantle surface wherein one winding of the heat conductor coil can be inserted into the tubular section. In this connection it should be emphasized that such a securing element is not limited to heating elements with a heat conductor coil according to the invention. Instead, the securing elements according to the invention can be used in connection with all known heat conductors of the prior art which are to be fastened indirectly on a support element.

BRIEF DESCRIPTION OF THE DRAWING

In the drawing:

FIG. 8 shows a further embodiment of a securing element suitable in connection with the invention;

FIG. 9 shows another embodiment of a securing element suitable in connection with the invention;

FIG. 10 shows a front view of an especially advantageous embodiment of a securing element;

FIG. 11 is a side view of the securing element illustrated in FIG. 10;

FIG. 12 is a plan view onto the securing element illustrated in FIGS. 10 and 11; and FIG. 13 is a perspective view of the securing element illustrated in FIGS. 10 through 12.

DESCRIPTION OF THE PREFERRED EMBODIMENTS

Figure 2:
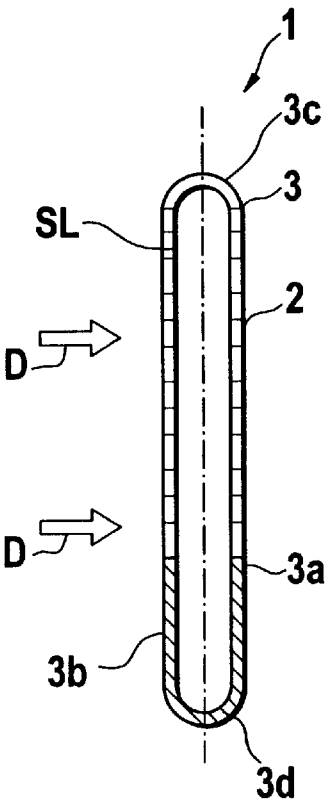
FIG. 2 shows a cross-section of the heat conductor coil according to FIG. 1.
Figure 1:
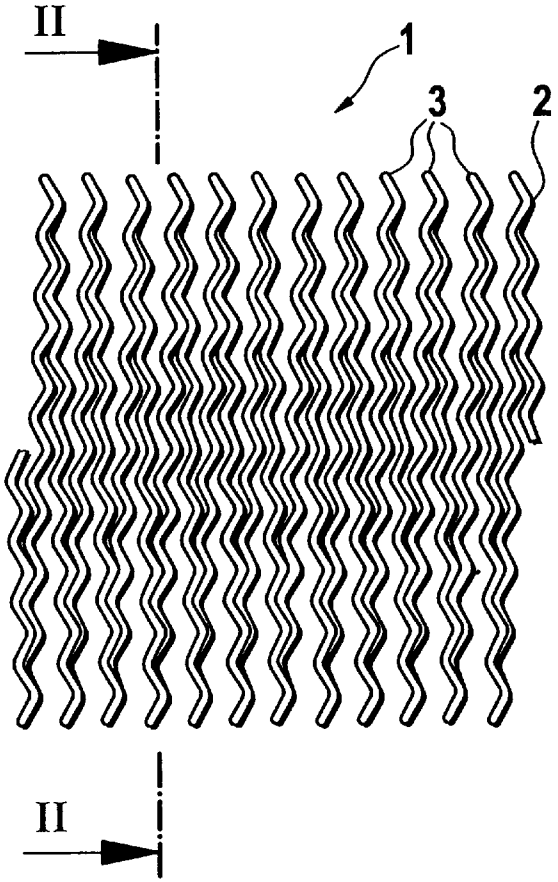
FIG. 1 shows a detail of a plan view onto a heat conductor coil according to the invention for an electrical resistance heating element.

In FIG. 1 a heat conductor coil 1 according to the invention is shown in a side view, i.e., in a view from the direction in which the medium to be heated flows through it. A cross-section of the coil 1 according to FIG. 1 is shown in FIG. 2. It illustrates how the heat conductor wire 2 is formed to flat-rectangular windings 3 having two substantially straight longitudinal sides 3*a* and 3*b* with approximately semi-circular deflection locations 3*c* and 3*d*. This generally known coil shape has an advantage relative to circular cross-sections primarily in that it has a minimal width extension, and therefore a reduced space requirement in the flow-through direction.

Figure 3:
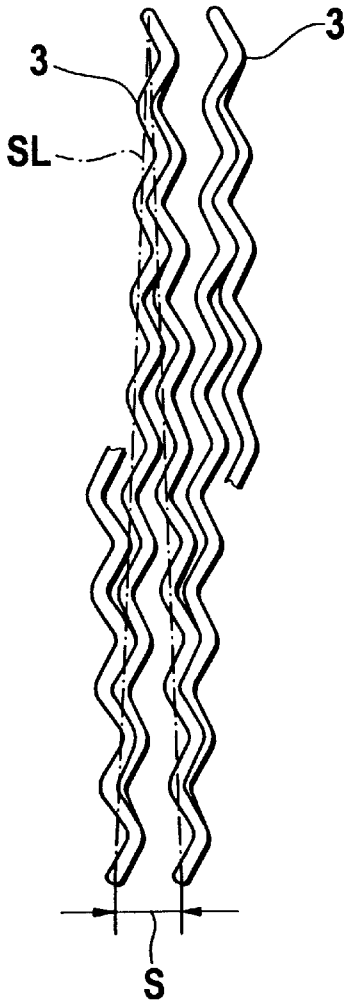
FIG. 3 shows a section of FIG. 1 on an enlarged scale.

As illustrated in FIG. 1, and particularly also in the illustration of FIG. 3 on a larger scale, the heat conductor 2 forming the coil 1 over the course of its windings, in particular, in the circumferential surface defined by the ascending line SL of the coil, is deflected out of the ascending line SL of the coil alternatingly in opposite directions. The coil wire thus has within this circumferential surface a substantially undulated course. In particular FIG. 1 shows that in the through-flow direction D the forwardly and rearwardly -positioned sections of the individual windings 3 of the coil 1 overlap one another so that the flow-through cross-section in particular in the central area is tightly and, primarily, uniformly penetrated by the heating wire. This results in a very fine air turbulence which not only results in a reduction of the energy consumption but also, because of reduced heat stress, in a long service life of the coil.

A heat conductor coil 1 configured in this way according to the invention can be used basically in any suitable electrical resistance heating device as a heating element, provided, there is the possibility to secure the coil freely within the airflow in a non-vibrating manner. Particularly advantageous appears to be the use in connection with a heating element wherein one or more coils of this type are fastened, with interposition of securing elements, on a support configuration, in particular, a support plate. One possibility for the attachment of the heat conductor coils with a flat-oval cross-section by means of securing elements is known from German patent document DE 44 43 725 A1, wherein the extension direction of the coil can be parallel to the plane of the support plate as well as at a right angle thereto.

Figure 4:
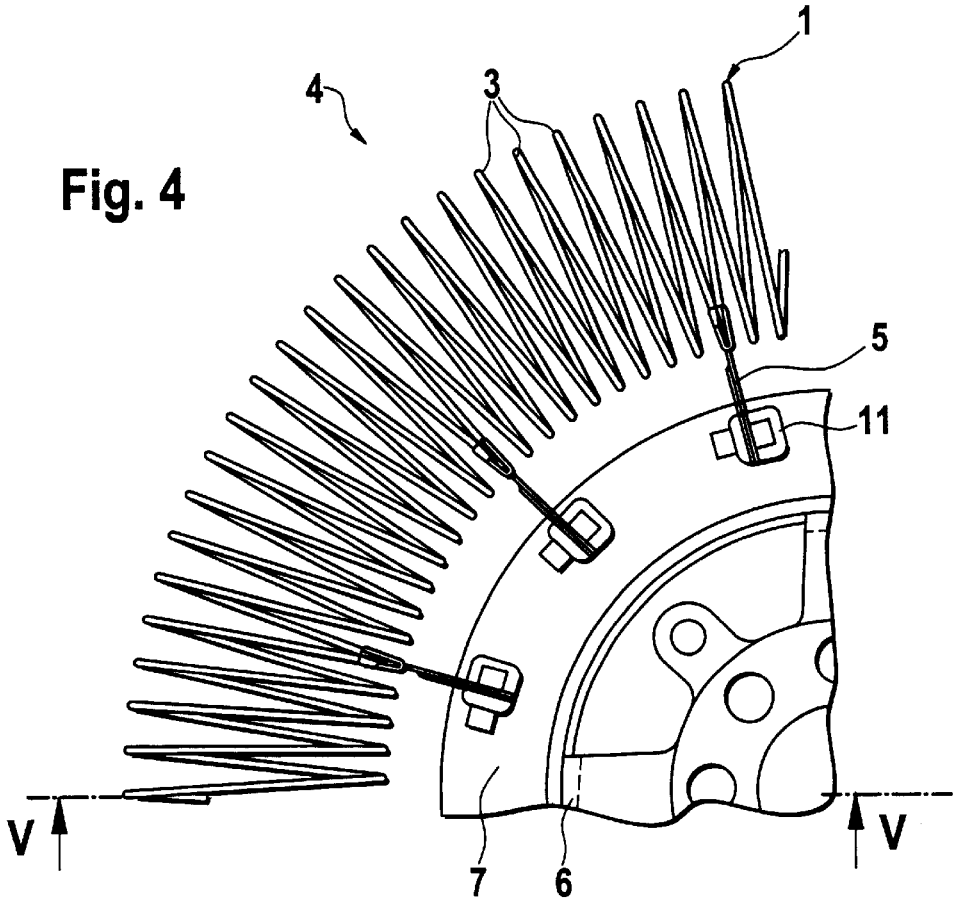
FIG. 4 shows a part of a plan view onto a circular heating element.
Figure 5:
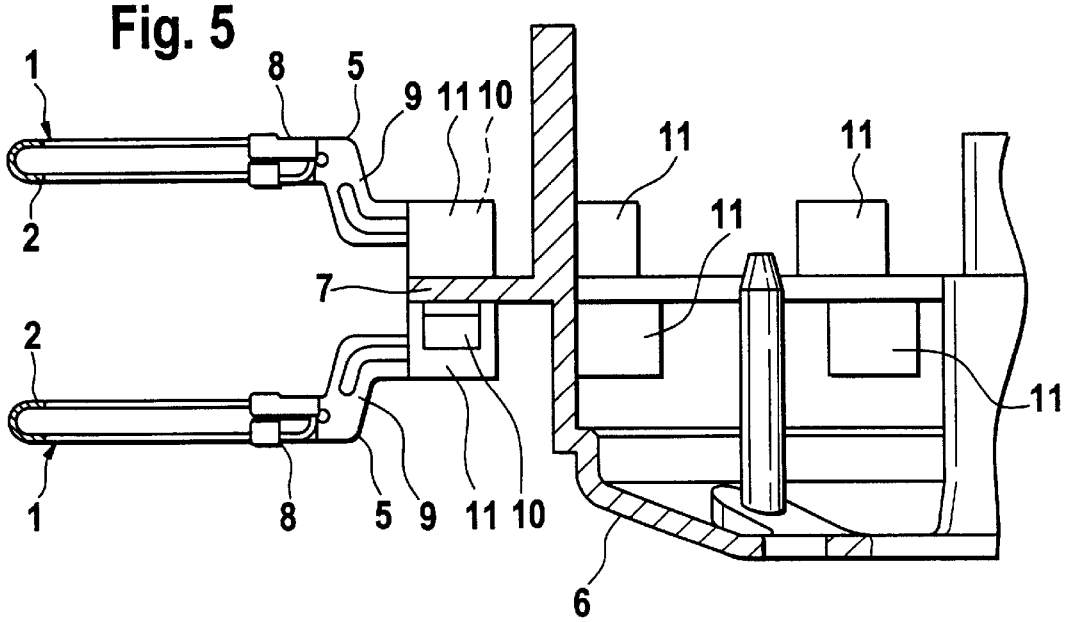
FIG. 5 shows a cross-section along the line V—V of FIG. 1.

One example for the use of a coil according to the invention in a heating element is illustrated in FIGS. 4 and 5. In FIG. 4 a quarter circle section of a circular heating element 4 is illustrated in which a heat conductor coil 1 bent to a circular ring-shape is secured by means of individual securing elements 5 on a circular support plate 6 in the form of a disc. It is understood in this connection that the heat conductor coil 1 in the illustration of FIG. 4 has the shape illustrated in FIG. 1—in FIG. 4 the coil is illustrated with a straight course of the individual windings only for simplifying the drawings.

FIG. 5 shows a cross-section along the line V—V in FIG. 4 which shows that radially outside of the support disc 6, above and below an annular disc 7, two heat conductor coils 1 are fastened parallel and at a spacing from one another by means of securing elements 5. The securing elements 5 engage with one securing part a winding 3 of the coil 1, respectively, and are fastened by means of a foot part 10 (not shown) arranged on the other end of the angled shaft 9 in a socket 11, respectively. This socket 11 in this embodiment is formed as a unitary part of the material of the support disc 6, preferably plastic. A heating element of the kind illustrated in FIGS. 4 and 5, i.e., with a circular ring-shaped heat conductor coil 1, is to be used preferably in circular flow-through cross-sections.

Figure 6:
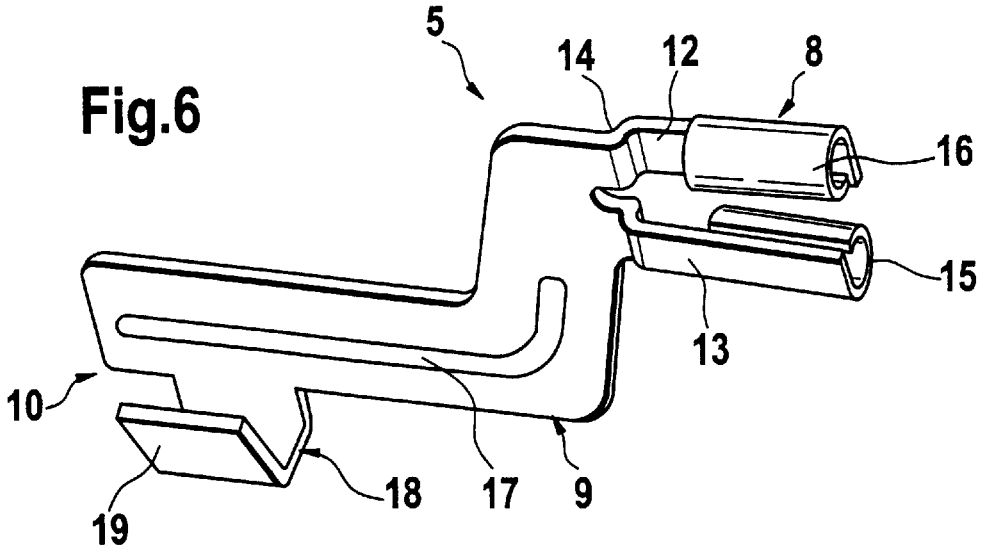
FIG. 6 is a perspective view of a securing element.
Figure 7:
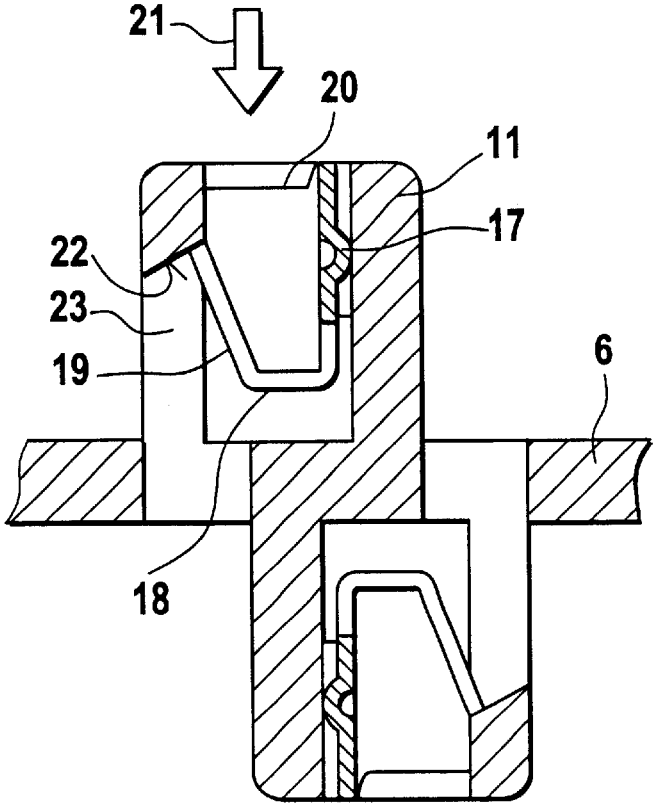
FIG. 7 is a detail of a cross-section of the support plate with attachment of a securing element according to FIG. 6.

The invention relates not only to the configuration of heat conductor coils, as described above, but also to the configuration of the securing parts 8 which are provided for securing a heat conductor coil 1 almost at a point and to fasten it on the support disc 6. A particularly advantageous configuration of such securing elements, which on the one hand are suitable to positionally fix the heat conductor coil 1, but, on the other hand, also to fasten the coil either within the plane of the support disc 6 (see FIG. 5) or at a right angle thereto (see FIGS. 8 and 9), can be explained in connection with FIGS. 6 and 7. FIG. 6 shows a securing element 5 on an enlarged scale in a perspective view and FIG. 7 shows its attachment on the support disc 6.

As already mentioned, the securing element 5 is comprised of a shaft 9 having arranged on one end a securing part 8 and on the other end a foot part 10. Expediently, the securing element 5 is a stamped part of sheet metal which can then be shaped in a corresponding way. Advantageously, the sheet metal is stainless steel which has a minimal heat conductivity and thus provides a reduced thermal stress for the support disc 6.

The securing part 8 provided for fixation of the coil is comprised of two arms 12, 13 which, downstream of an angled portion 14, project, slightly spread apart, away from the plane formed by the shaft 9. The spreading corresponds to the slope S of the coil. Each one of the two arms 12, 13 has at its end a lateral projection 15, 16. In the mounting state, the projections 15, 16 are first positioned flat but are then bent about a section of a winding 3, respectively, after combining the securing element 5 with a heat conductor coil 1. Each projection 15, 16 thus forms a closed receptacle for enclosing a portion of a winding of the coil 1. The angled portion 14 provides a stop for the lower end of a winding of the coil 1.

While the shaft 9 may also comprise a groove-shaped stiffening rib 17, the foot part 10 has a projection 18 projecting on one side laterally away from the shaft 9. The projection 18 in cross-section is approximately U-shaped with a slantedly upwardly extending leg 19 thus forming a type of spring.

FIG. 7 shows on an enlarged scale a section of the socket parts 11 illustrated already in FIG. 5 which are arranged on the support disc 6, primarily connected thereto as a monolithic part. Each of these socket parts 11 forms a substantially rectangular receptacle 20 for a foot part 10 of a securing element 5. When inserting the securing element 5 from above (arrow 21), the projecting free leg 17 moves elastically backward and forms in the end position a stop on an undercut edge 22 of a lateral cutout 23. The stiffening rib 17 is positioned on the opposite wall of the receptacle 20. This provides an extremely simple but also safe mounting of the parts which is primarily also suitable for automated assembly.

In FIGS. 8 and 9, as already mentioned, the possibility is illustrated how, with correspondingly formed securing elements, a heat conductor coil according to the invention can also be connected to a planar support plate such that the longitudinal extension of the coil is at a right angle to the plane of the support plate. FIG. 8 shows a side view of the coil and FIG. 9 shows a cross-section.

FIG. 8 shows how a winding 3 of the coil is secured by a securing part 25 which is fastened, in turn, on the support plate 26. It is clearly shown that the shaft 27 of the securing element 25, which is bent to a Z-shape in cross-section, extends upwardly into two arms 28, 29 which, in the way illustrated in FIG. 6, surround a section of a winding 3 of the coil 1. In this connection, spreading of the arms according to the slope of the coil 1 can also be seen. On the foot part 30 of the shaft 25, two tabs 31, 32 are formed which are pushed through slots 33 in the support plate 26 and are then bent.

In this way, it is possible to fasten a heat conductor coil 1 according to the invention substantially in a freely salient arrangement on one side of the support element in order to expose it substantially unhindered to the flowing medium.

The securing element 34 illustrated in FIGS. 10 to 13 is comprised substantially of a securing part 35 and a foot part 36. The foot part 36 has three tabs 37 which in the stretched form are pushed through openings into the support plate (not shown) and, for anchoring them, are subsequently bent at a right angle.

The securing part 35 is comprised substantially of a tubular section 38 which with regard to its cross-sectional dimensions is matched to the geometry of the coil 39. In the present case, the tubular portion 38 surrounds a narrow approximately rectangular hollow space into which the pointed end of a winding of the coil 39 is inserted. The longitudinal extension of the hollow space corresponds thus to the width of the winding of the coil 39. The transverse extension of the hollow space corresponds at least to the thickness of the heat conductor. For taking into consideration the pitch of the coil 39 and optionally of the deflections of the heat conductor in the longitudinal direction of the coil 39, the transverse extension of the hollow space can be advantageously selected to be larger, for example, twice the thickness of the heat conductor.

The tubular section 38 has a closed mantle surface with the exception of two cutouts 40 and 41 in the free edge area positioned diagonally opposite one another. The cutouts 40 and 41 extend up to the upper free end of the tubular section 38 and allow passage of the heat conductor forming the coil 39.

The end face of the securing part 35 in the area of the foot part 36 can be open because the hollow space is closed by the support plate after mounting on a support plate. The oppositely positioned upper end of the securing part 35 can also remain open; however, preferably a closed embodiment is provided which is illustrated in FIGS. 10 through 13.

The lid 42 according to the invention is comprised of the flap elements 43 and 44. Both flap elements 43 and 44 form a part of the mantle surface and are connected, staggered relative to their longitudinal direction, on the oppositely positioned edges of the tubular section 38. After insertion of a winding of the coil 39 into the tubular section 38, the flap elements 43 and 44 are bent about their folding axis which coincides with the edge. As a result of the longitudinal staggering, the two flap elements 43 and 44 complement one another such that the entire opening at the end face of the securing element 35 is closed. The outer corner of the flap elements 43 and 44 is cut off, respectively, so that guiding the heat conductor therethrough is facilitated in cooperation with the cutouts 40 and 41.

In this way, a receptacle that is closed on all sides for a winding of the heat conductor coil 39 is provided which hardly presents a surface of attack for the dust and lint particles contained within the airflow. Accordingly, collection of dust and lint is substantially prevented and thus also the risk of combustion within a heating element.

While specific embodiments of the invention have been shown and described in detail to illustrate the inventive principles, it will be understood that the invention may be embodied otherwise without departing from such principles.

What is claimed is:

1. A heat conductor coil for heating a flowing gaseous medium and configured to be attached to a support configuration, the heat conductor coil comprising:

a heat conductor wound in windings following an ascending line of a coil to form the heat conductor coil, wherein the ascending line of the coil defines a circumferential surface of the heat conductor coil;

the heat conductor deflected alternatingly in opposite directions within the circumferential surface of the coil out of the ascending line of the coil, the heat conductor being a wire having circular cross-section.

2. The heat conductor coil according to claim 1, wherein the deflection is zigzag-shaped.

3. The heat conductor coil according to claim 1, wherein the deflection is undulated.

4. The heat conductor coil according to 1, wherein the heat conductor is comprised of a PTC thermistor wire.

5. The heat conductor coil according to claim 1, having an elongate cross-section deviating from a circular cross-section.

6. The heat conductor coil according to claim 5, wherein the cross-section is substantially rectangular with two substantially straight longitudinal sides and U-shaped deflection locations.

7. An electrical resistance heating element for heating a flowing gaseous medium, comprising:

at least one heat conductor coil;

a support plate; and securing elements positioned between the at least one heat conductor coil and the support plate for connecting the at least one heat conductor coil to the support plate, the securing elements comprising a shaft and a securing part connected to the shaft for holding a winding of the heat conductor coil and a foot part for attaching the shaft to the support plate, wherein the securing part has two arms provided with a receptacle for fastening a section of the winding of the heat conductor coil, respectively.

8. The heating element according to claim 7, wherein the arms are spread apart so as to match a slope of the coil.

9. The heating element according to claim 7, wherein the receptacles are formed by projections laterally projecting from the arms, wherein the receptacles are configured to be placed about a section of the winding of the coil.

10. The heating element according to claim 7, wherein the foot part comprises a projection laterally projecting away from the shaft and bent to a spring of a U-shaped cross-section.

11. The heating element according to claim 10, wherein the support plate has sockets for attaching the securing elements to the support plate, wherein the sockets receive the spring, wherein the spring and the socket engage one another by a snap-into-place connection.

12. The heating element according to claim 11, wherein the shaft has at least one reinforcement rib in the form of a groove extending in the longitudinal direction of the shaft.

13. The heating element according to claim 12, wherein the securing element is a stamped part.

14. A securing element for attaching a heat conductor coil on a heating element, the heat conductor coil comprising: a heat conductor wound in windings following an ascending line of a coil to form the heat conductor coil, wherein the ascending line of the coil defines a circumferential surface of the heat conductor coil; the heat conductor deflected alternatingly in opposite directions within the circumferential surface of the coil out of the ascending line of the coil, the heat conductor being a wire having circular cross-section; the securing element comprising:

a securing part for holding a winding of the heat conductor coil and a foot part for attaching the securing element to a support element;

wherein the securing part is a tubular section with a substantially closed mantle surface;

wherein the tubular section is configured to receive a winding of the heat conductor coil.

15. The securing element according to claim 14, wherein the tubular section in cross-section is matched to a pitch and geometry of the heat conductor coil.

16. The securing element according to claim 14, wherein the tubular section has a lid for closing an end face of the tubular section.

17. The securing element according to claim 16, wherein the lid is a part of the tubular section, wherein the lid is configured to bend about an upper edge of the tubular section for closing.

18. The securing element according to claim the 17, wherein the lid is comprised of two parts, wherein the two parts are flap elements fastened on opposite edge portions of the upper edge of the tubular section.

19. The securing element according to claim 16, wherein the lid has a cutout for allowing passage of the heat conductor coil.

20. The securing element according to claim 14, wherein the tubular section has a free end and wherein the free end has an edge area with cutouts for allowing passage of the heat conductor coil.

21. The securing element according to claim 14, wherein the longitudinal edges of the mantle surface of the tubular section are rounded.

* * * * *